US007242288B2

(12) United States Patent
Kaiser et al.

(10) Patent No.: US 7,242,288 B2
(45) **Date of Patent: *Jul. 10, 2007**

(54) METHOD FOR INITIATING A REMOTE HAZARDOUS CONDITION DETECTOR SELF TEST AND FOR TESTING THE INTERCONNECTION OF REMOTE HAZARDOUS CONDITION DETECTORS

(75) Inventors: Timothy D. Kaiser, Plain City, OH (US); Charles D. Adkins, Plain City, OH (US)

(73) Assignee: Ranco Incorporated of Delaware, Wilmington, DE (US)

( * ) Notice: Subject to any disclaimer, the term of this patent is extended or adjusted under 35 U.S.C. 154(b) by 68 days.

This patent is subject to a terminal disclaimer.

(21) Appl. No.: 10/966,832

(22) Filed: Oct. 15, 2004

(65) Prior Publication Data

US 2006/0082452 A1 Apr. 20, 2006

(51) Int. Cl.
*G08B 29/00* (2006.01)

(52) U.S. Cl. ..... 340/506; 340/514

(58) Field of Classification Search ..... 340/506, 340/514, 508, 505, 693.6, 628
See application file for complete search history.

(56) References Cited

U.S. PATENT DOCUMENTS 5,202,673 A * 4/1993 Conrad ..... 340/524
5,705,979 A * 1/1998 Fierro et al. ..... 340/517
6,196,468 B1 3/2001 Young
6,224,481 B1 5/2001 McCabe
6,580,950 B1 6/2003 Johnson et al.
6,611,204 B2 8/2003 Schmurr
6,624,750 B1 * 9/2003 Marman et al. ..... 340/506
6,902,117 B1 6/2005 Rosen
6,950,016 B2 * 9/2005 Farley ..... 340/514

OTHER PUBLICATIONS

International Search Report, International Application No. PCT/US2005/36496, date of actual completion of the international search Apr. 24, 2006, date of actual mailing of the international search report Jul. 26, 2006, 1 pages.

* cited by examiner

*Primary Examiner*—John Tweel, Jr.
(74) *Attorney, Agent, or Firm*—Reinhart Boerner Van Deuren P.C.

(57) ABSTRACT

A method of testing the operational status of remotely distributed hazardous condition detectors is provided. The method utilizes the detector's self-test button to initiate a detector self-test. Once the self-test is complete, the detector's alarm is silenced and a remote self-test signal is sent to the interconnected remote hazardous condition detectors. The remote detectors, on receipt of this signal, will initiate a self-test of their own as if a user had depressed their test button. The user, with the local detector's alarm now silenced, is better able to hear the remotely interconnected detector's alarm. To verify that the remote self-test signal is received, thus verifying the operational integrity of the communications link, the remote detectors may sound an alarm pattern indicative of the receipt of the signal before initiating their self-test.

21 Claims, 5 Drawing Sheets

METHOD FOR INITIATING A REMOTE HAZARDOUS CONDITION DETECTOR SELF TEST AND FOR TESTING THE INTERCONNECTION OF REMOTE HAZARDOUS CONDITION DETECTORS

FIELD OF THE INVENTION

This invention relates generally to interconnected hazardous condition detectors, and more particularly to test methods for use therewith.

BACKGROUND OF THE INVENTION

As the life-saving benefits of hazardous condition detectors are recognized, their usage continues to expand. Such hazardous condition detectors include smoke detectors, carbon monoxide detectors, flammable vapor detectors, combination units, etc. Indeed, the installation of such detectors is mandated in many states by building code for all new construction of single and multi-family dwellings, office buildings, schools, etc. Further, many areas also require that such detectors be installed in existing homes before they may be sold.

Because many such structures include multiple floors, rooms, or areas on or in which a remotely located hazardous condition detector may not be heard, it is recommended that multiple hazardous condition detectors be located throughout the structure or dwelling to increase the likelihood of early detection of a hazardous condition. Such early detection is a direct factor in the survivability of the occupants within the dwelling or structure.

In a typical single family dwelling having a basement and two stories, at least one hazardous condition detector should be placed on each floor of the dwelling. That is, at least one detector should be placed in the basement, on the first floor, and on the second floor. In this way, a hazardous condition that originates in the basement may be detected sooner than if the only hazardous detector were located on the second floor. Indeed, even in single floor plan dwellings or structures, it is recommended to include multiple detectors at various locations. For example, a hazardous condition detector may be located in the utility room housing the furnace, water heater, etc., one in the kitchen and one in each of the bedrooms or in the hallway by the bedrooms. Regardless of the configuration, however, the use of multiple hazardous condition detectors provides the advantage of detecting the hazardous condition early to allow the occupants as much time as possible to avoid danger.

While the use of multiple hazardous condition detectors at different locations throughout a dwelling or structure increases the likelihood of detecting a hazardous condition early, the layout of the dwelling or structure may well prevent an occupant from hearing the alarm of the hazardous condition detector located in proximity to the hazardous condition when it sounds. For example, if the hazardous condition detector in the basement of a two-story single family dwelling were to detect a hazardous condition and sound its alarm, the occupants who may be asleep on the second story may not be able to hear the alarm sounding in the basement. Indeed, many dwellings are constructed with insulation between the stories for the very purpose of stopping the transmission of noise therebetween. However, such sound insulation may well detract from the advantage of installing multiple hazardous condition detectors throughout the dwelling. If the hazardous condition continues to expand, the other detectors in the dwelling or structure will eventually detect this hazardous condition and hopefully alert the occupant of the existence of such a condition in time for the occupant to escape the danger.

To overcome this problem, the hazardous condition detectors may be interconnected or networked together utilizing a wired connection or wireless transmission. In some installations the hazardous condition detectors report to a central control module which may then command the other hazardous condition detectors to sound their alarms throughout the dwelling. In other embodiments, the hazardous condition detectors communicate among themselves without requiring a central control module. In such an installation the detecting hazardous condition detector sounds its alarm and transmits a hazardous condition detected signal to the other interconnected hazardous condition detectors. These detectors then sound their alarm to notify the occupant of the detected hazardous condition within the dwelling.

Circuitry within the detectors ensures that only an alarm for the detected hazardous condition be sounded. That is, it is common for many dwellings or structures to include multiples types of hazardous condition detectors, each having a distinctive alarm pattern to alert the user to the different types of detected hazardous conditions. For example, a typical single family dwelling may include both smoke and carbon monoxide detectors. In such an installation, the detection of smoke will result in only smoke alarms being sounded throughout the dwelling. That is, no carbon monoxide alarm signal will be sounded by a carbon monoxide detector because smoke is detected by one of the other hazardous condition detectors. The converse is also true. As a result, only the hazardous condition detectors that are capable of sounding the alarm corresponding to the detected hazardous condition will sound such an alarm. The other hazardous condition detectors that are not capable of sounding an alarm that corresponds to the detected hazardous condition will remain silent. One such system of providing communication between hazardous condition detectors is provided in U.S. Pat. No. 6,611,204, entitled "Hazard Alarm, System, and Communication Therefore", the teachings and disclosure of which are hereby incorporated in their entireties by reference thereto. However, other systems of communication and interconnection between hazardous condition detectors may also be used.

Since hazardous condition detectors are typically silent due to the absence of a hazardous condition, it is recommended that the user periodically test the functionality of the hazardous condition detector to ensure its continued operation. Typically, each hazardous condition detector includes a self-test button that may be depressed by the user to initiate a detector self-test. To initiate the test, the user depresses and holds the button while the detector performs its internal self-test. If the user releases the button prior to the completion of the self-test, the detector will typically abort the self-test. However, if the user continues to depress the test button, the detector will run its internal self-test, typically resulting in the sounding of the hazardous condition detector alarm. Once the alarm has sounded the user knows that the hazardous condition detector is functioning properly and may release the button.

While such a test may be completed by the user in less than a minute, the requirement that the user test each and every one of the distributed hazardous condition detectors within the dwelling or structure becomes quite time consuming. Further, since the test button is typically located on the actual detector itself, and since most detectors are mounted on the ceiling, the user also typically needs to utilize a step ladder to reach the detector test button. This effort combined with the time for each individual test, while minimal in comparison to the safety features provided, often results in the user not conducting the recommended functionality tests of the hazardous condition detectors. This may result in a situation where some of the hazardous condition detectors may not be functional without the user being aware of the lack of protection provided thereby. Further, even if such tests are performed on each individual detector, the user cannot be assured that they will all sound if one of them detects a hazard because these individual tests do not test their interconnection.

To overcome this problem, many hazardous condition detectors include the capability to transmit a signal to the other interconnected hazardous condition detectors if the test button remains depressed once the hazardous condition detector has completed its self-test. The interconnected detectors, upon receipt of the signal, will sound their alarms just as if it had received a signal from a hazardous condition detector that had detected a hazardous condition. In this way, the user can be assured that the interconnection between these hazardous condition detectors and/or their ability to communicate have not been compromised.

Unfortunately, such a system may actually provide a false sense of security to the user. This is because the signal provided to the interconnected detectors does not actually result in these interconnected detectors running any type of internal diagnostic test. Instead, the received signal is used by these interconnected detectors merely to sound the alarm to alert the user of the fact that another detector has actually detected a hazardous condition. In actuality, however, this interconnected detector may well be malfunctioning such that it is incapable of detecting a hazardous condition itself. As such, the user is still required to physically go to each of the interconnected hazardous condition detectors and depress the self-test button to be able to determine the operability of each of the detectors. However, as discussed above, such a requirement often results in the tests not being run as recommended, resulting in the failure to replace non-functioning detectors.

While the interconnect test method is effective to test the integrity of the interconnection between the hazardous condition detectors themselves, the user may be unable to tell if the test is successfully passed or not. This is because the only indication of test success is the sounding of the remote detectors' alarm. However, so long as its self-test button is depressed, the hazardous condition detector will continue to sound its alarm. Since a typical hazardous condition alarm is at least 85 db, the user who is standing close enough to the detector to actually depress its self-test button is unlikely to be able to hear the alarm of the remotely located hazardous condition detectors. This is particularly true when the remotely located hazardous condition detectors are installed on other floors of a multi-story dwelling or in remote locations.

As a result, the current testing methods are wholly ineffective for testing anything other than the particular hazardous condition detector whose self-test button has been depressed. As such, the user is still required to physically go to each hazardous condition detector and perform its own self-test. As indicated above, however, such a requirement will typically result in the system not being tested by the user as recommended due to the time and hassle involved in physically going to each remotely located hazardous condition detector, climbing on the step ladder, and holding the self-test button for a time sufficient to complete that detector's internal self diagnostic test. Even if this were done, however, the user still cannot be assured that the interconnection between the hazardous condition detectors has not been compromised.

Therefore, there exists a need in the art for a reliable and effective method to test the integrity of the interconnection between remotely located hazardous condition detectors and to test the remotely located hazardous condition detectors themselves without requiring the user to physically access each such remotely located hazardous condition detector.

These and other advantages of the invention, as well as additional inventive features, will be apparent from the description of the invention provided herein.

BRIEF SUMMARY OF THE INVENTION

In view of the above, it is an object of the present invention to provide a new and improved remote hazardous condition detector test method. More particularly, it is an object of the present invention to provide a new and improved remote hazardous condition detector test method that may be initiated from a single interconnected or networked hazardous condition detector. Further, it is an object of the present invention to provide a new and improved remote hazardous condition detector test method that allows a user to determine the operational integrity of the remotely located hazardous condition detectors from the location of the initiating hazardous condition detector. Still further, it is an object of the present invention to provide a new and improved remote hazardous condition detector test method that also allows a user to determine the operational integrity of the interconnect or communications link from the location of the initiating hazardous condition detector.

In one embodiment of the present invention a user may initiate a hazardous condition detector self-test by depressing the test button on the detector or one located remotely from the detector or otherwise initiate a detector self-test. If the user were to continue holding the test button in its depressed position after completion of the hazardous condition detector self diagnostic test, that detector would silence its alarm and transmit a remote detector self-test signal to the other interconnected hazardous condition detectors. These remote detectors will then initiate their own internal self test. The user would then be able to listen for the other detectors sounding their alarms to determine the operational integrity of these other detectors. Such remote testing will also allow the user to verify the operational integrity of the communications link between the detectors.

However, if a remote detector fails its self test, it will not sound its alarm. In such a case, the user will not be able to determine if the lack of the remote alarm sounding is a result of a failure of the self test, or if it is a result of a failure in the communications link that prohibited the remote detector from receiving the test signal. To allow isolation of the failure, one embodiment of the present invention sends a remote interconnect test signal to the remote detectors in addition to the self test signal. Preferably, this remote interconnect test signal is sent prior to the self test signal so that an audible confirmation that the communications link may be provided immediately, before the remote detector would have had time to complete its self test. Alternatively, the remote detectors upon receipt of the remote self test signal will initially sound an indication of receipt of the signal to provide the audible confirmation of the operational integrity of the communications link between the detectors.

In a preferred embodiment of the present invention, selection of the test button or otherwise commanding of the self-test functionality will initiate the detector's self-test. If this self-test is successful, the hazardous condition detector will sound its horn pattern as dictated by its internal self-test procedure. Once this self-test has been completed, the alarm on the hazardous condition detector will be silenced even if the test button is still depressed or the command for this functionality is still present. Indeed, if the test button is still depressed once the self-test has been completed, the hazardous condition detector will transmit a remote self-test signal to the other interconnected hazardous condition detectors. This transmission may be via a wired or wireless interconnection. In a highly preferred embodiment, the transmission of the remote self-test signal will be accomplished even if the local detector fails its own internal self-test and never sounds its horn pattern so long as the test button remains depressed once the self-test has been completed.

In this embodiment, the remote hazardous condition detectors will receive the remote self-test signal via the interconnect, wirelessly, etc. Once this signal has been received the remote hazardous condition detector will initiate its own internal self test. If completed successfully, the remote detector will sound its alarm pattern. In an alternate embodiment, the remote detector will first sound an alarm pattern to verify the operational integrity of the communications link.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention, and together with the description serve to explain the principles of the invention. In the drawings.

Figure 1:
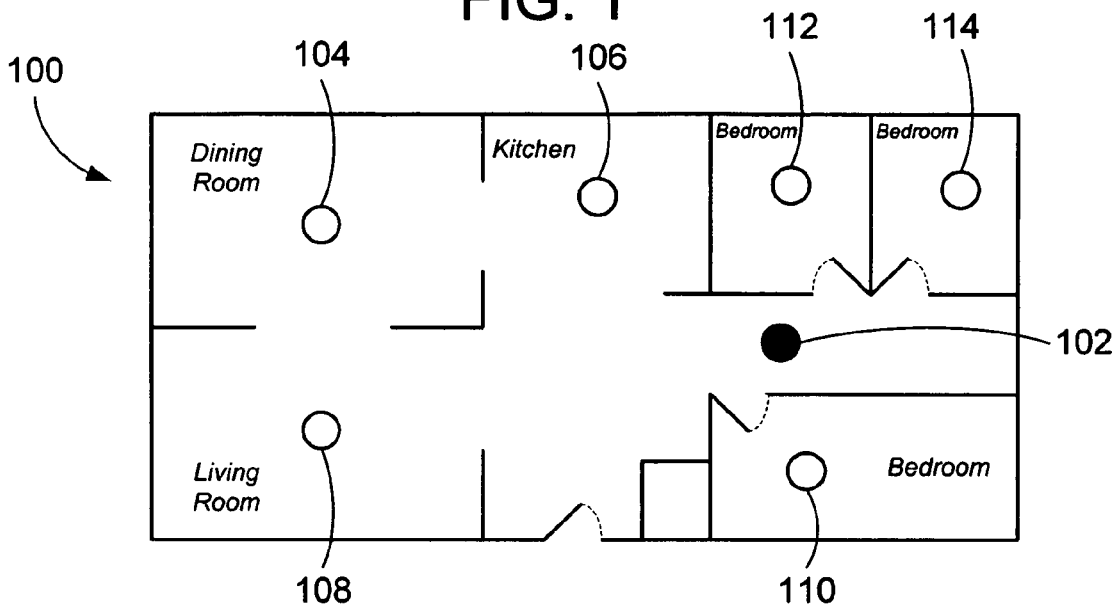
FIG. 1 is an exemplary smoke detector placement diagram for a single floor plan existing home.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Because every additional second of notice that an occupant has of the existence of a hazardous condition increases the occupants' chance of escaping danger, the use of multiple hazardous condition detectors throughout a dwelling or other structure is highly desirable as discussed above. Indeed, complete coverage protection is achieved by installing an appropriate hazardous condition detector in every room of a dwelling. Smoke detectors should be installed in accordance with the National Fire Protection Associations Standard 72 (National Fire Protection Association, Battery March Park, Quincy, Mass. 02269). The NFPA standard identifies the minimum requirement for locating smoke alarms in family living units. It states: "2-2.1.1.1 smoke alarms shall be installed outside of each separate sleeping area in the immediate vicinity of the bedrooms and on each additional story of the family living unit including basements and excluding crawl spaces and unfinished attics. In new construction, a smoke alarm also shall be installed in each sleeping room." Further, Section 2-2.2.1 states that "in new construction, where more than one smoke alarm is required by 2-2.1, they shall be so arranged that operation of any smoke alarm shall cause the alarm in all smoke alarms within the dwelling to sound." The NFPA, 1993 Addition, Appendix A, however, clearly points out that "the required number of smoke alarms (as defined in the paragraphs above) may not provide reliable early warning protection for those areas separated by a door from the areas protected by the required smoke alarms. For this reason, it is recommended that the house holder consider the use of additional smoke alarms for those areas for increased protection. The additional areas include: basement, bedrooms, dining room, furnace room, utility room, and hallways not protected by the required smoke alarms."

Further, the California State Fire Marshal states that the minimum number of required smoke alarms is not enough to give the earliest warning under all conditions. The California State Fire Marshal states that "early warning fire detection is best achieved by the installation of fire detection equipment in all rooms and areas of the household as follows: "a smoke alarm installed in each separate sleeping area (in the vicinity, but outside the bedrooms), and heat and smoke alarms in the living rooms, dining rooms, bedrooms, kitchens, hallways, attics, furnace rooms, closets, utility and storage rooms, basements and attached garages."

It is clear that the earliest warning of a developing fire is best achieved by the installation of smoke alarms in all rooms and areas of the residence. Accordingly, the resident should install smoke alarms in every room of the residence, including basements and finished attics, even though this is not required by the typical code or standard. In addition, it is recommended that the homeowner interconnect all smoke alarms capable of being interconnected. Further, it is also recommended that a minimum of two smoke alarms be installed in every home, no matter how small the home (including efficiency apartments). Such maximum coverage can be achieved by installing smoke alarms in both required and recommended locations as illustrated and described below.

The NFPA requires a smoke alarm on every level and outside each sleeping area in existing construction. An existing household with one level and one sleeping area is required to have one smoke alarm. Such a required smoke alarm in a single story existing home 100 is illustrated by smoke alarm 102 as illustrated in FIG. 1. However, it is recommended that additional smoke detectors 104-114 be located in each of the dining room, kitchen, living room, and each of the three bedrooms, respectively.

Figure 2:
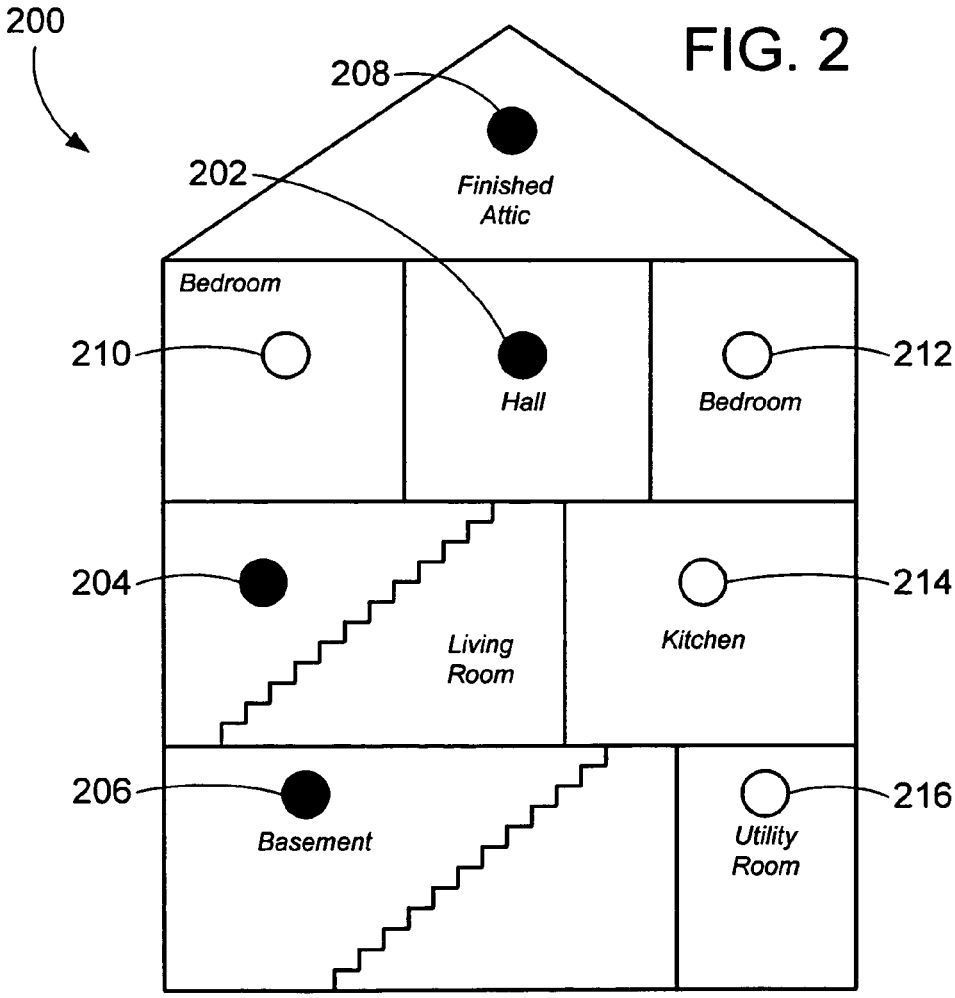
FIG. 2 is an exemplary smoke detector placement diagram for a two-story existing home.

In an existing two-story residence 200, such as that illustrated in FIG. 2, the NFPA requires that a smoke detector 202 be included outside the sleeping area, and detectors 204 and 206 be located on the first floor and in the basement, respectively. Further, the NFPA requires that a smoke detector 208 be included in a finished attic. To provide an added measure of safety, it is recommended that smoke detectors also be included in each of the bedrooms (210, 212), in the kitchen (214), and in the utility room (216).

Figure 3:
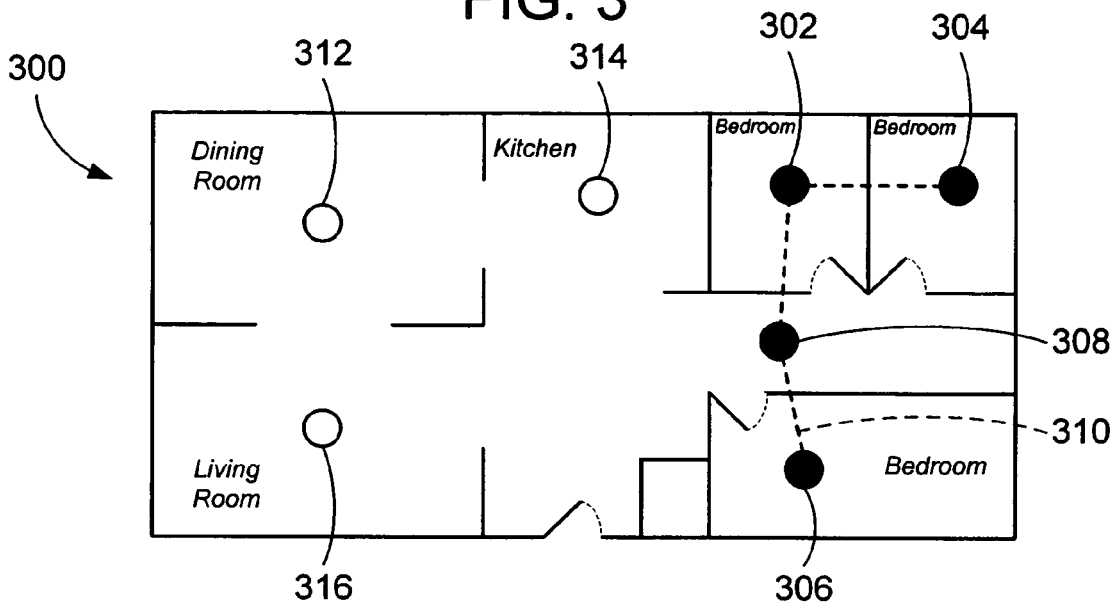
FIG. 3 is an exemplary smoke detector placement diagram for a single floor plan new construction home.

For new construction homes, the NFPA requires AC-powered, interconnected smoke alarms be installed each bedroom, outside each bedroom area, and on every level of the home. The NFPA also requires a minimum of two AC-powered, interconnected smoke alarms in any new construction home regardless of size. FIG. 3 illustrates a single story residence/apartment/mobile home 300 that includes the NFPA required smoke detectors in each of the bedrooms (detectors 302, 304, and 306) and outside the sleeping area (detector 308). As may be seen from this FIG. 3, each of the smoke detectors 302-308 are interconnected (as shown by dashed line 310). In addition to these required smoke detectors, the assignee of the instant application recommends that a smoke detector also be included in the dining room (detector 312), the kitchen (detector 314), and the living room (detector 316).

Figure 4:
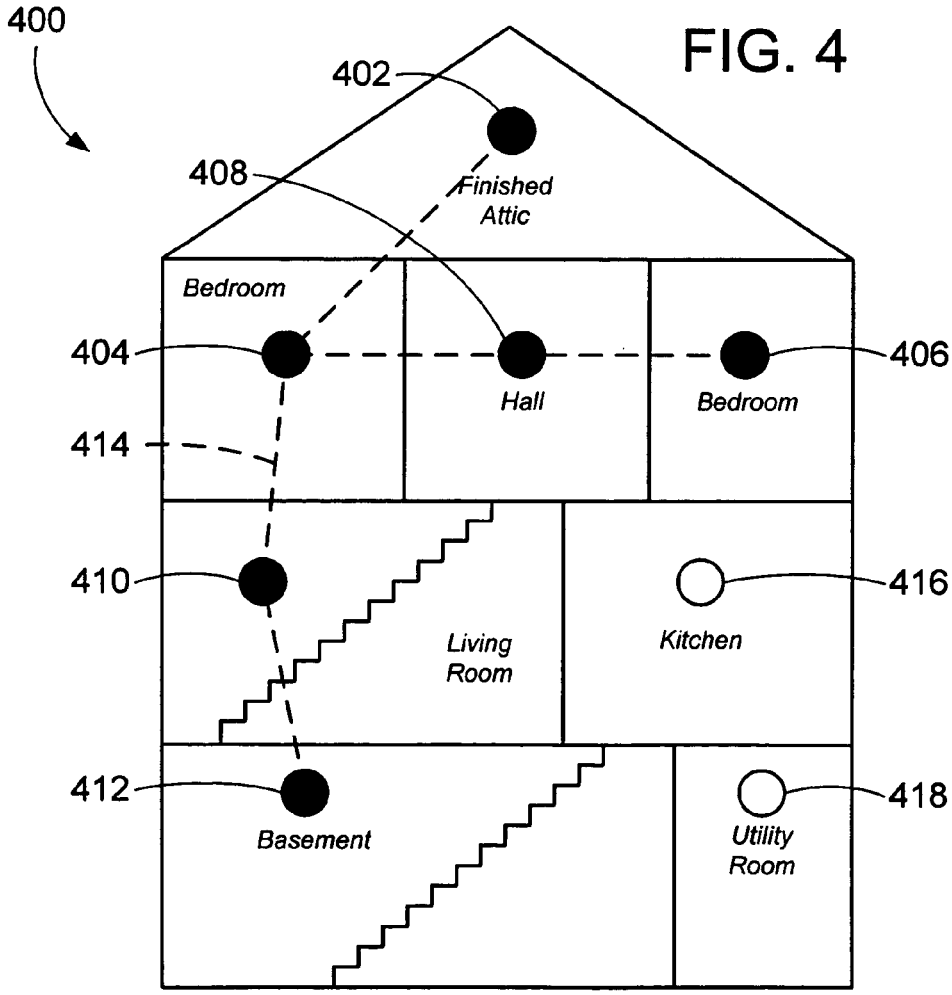
FIG. 4 is an exemplary smoke detector placement diagram for a two-story new construction home.

FIG. 4 illustrates an exemplary two-story new construction home 400 having both NFPA required and additional suggested smoke detectors installed therein. Specifically, the NFPA required smoke detectors include detector 402 in the finished attic, detector 404 and 406 in the bedrooms, detector 408 outside the sleeping area, and detectors 410 and 412 on every level of the two-story residence 400. As may be seen in this FIG. 4, the NFPA also requires that the smoke alarms be interconnected as illustrated by dashed line 414. The additional recommended smoke detectors include detector 416 in the kitchen and 418 in the utility room.

It should be noted that while these additional, recommended smoke detectors are not illustrated as being interconnected with the NFPA required smoke detectors, preferably such an interconnection is provided. As will be recognized by those skilled in the art, such an interconnection can be provided in a number of ways. Such interconnection methods may include a three-wire interconnect, a system bus, wireless communications, etc.

Figure 5:
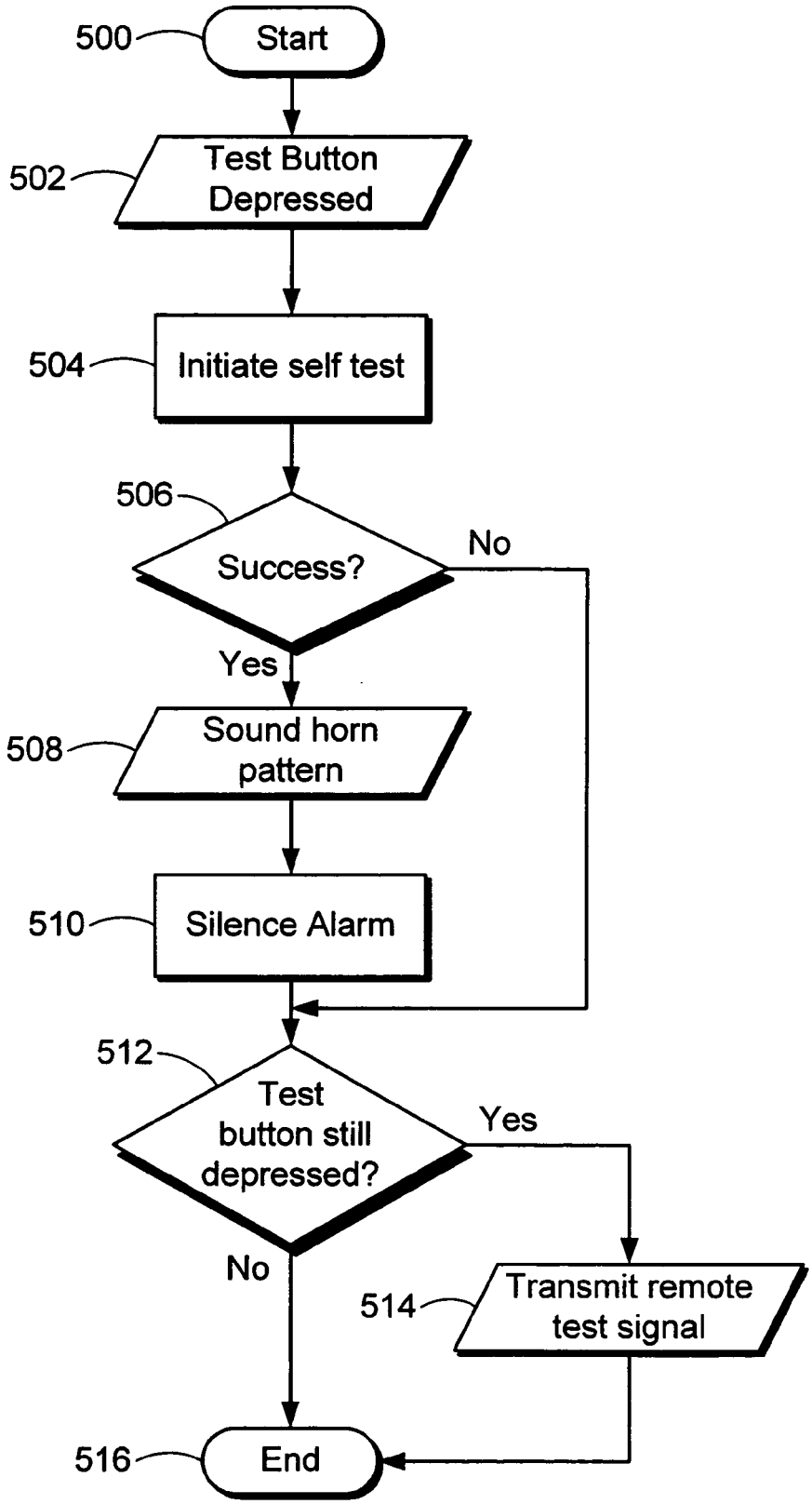
FIG. 5 is a flow diagram illustrating an embodiment of the method of the present invention.

Having described some exemplary installations of one type of hazardous condition detector in both existing and new construction homes, attention is now directed to the flow diagram of FIG. 5. This FIG. 5 illustrates an exemplary embodiment of a method of performing a self-test on a hazardous condition detector and a test of the operational integrity of the distributed hazardous condition detectors. Such a test increases the ability of the user to determine if the interconnected detectors are operating properly without requiring the user to physically go to each such detector. Specifically, the method the present invention is initiated 500 when the test button is depressed at step 502 by a user wishing to initiate a hazardous condition detector self-test. However, it should be noted that other methods of initiating the self-test may also be employed depending on the particular hazardous condition detector at which the user is located. Such methods may include the inclusion of a separate button located at a level easily accessed by the user, via a thermostat control panel, via a PC or other type of controller, etc. The hazardous condition detector thereafter initiates it's internal self-test at step 504. The particular tests performed during this self-test may vary, are beyond the scope of the instant invention, and therefore will not be discussed in detail herein. However, those skilled in the art are familiar with such self-tests performed on the functionality of the hazardous condition detectors.

If the self-test is successful 506 the detector will sound its appropriate horn pattern or patterns at step 508. Thereafter the hazardous condition detector will silence its alarm at step 510. This is a significant departure from prior self-test systems that continue to sound the alarm so long as the self-test button is depressed. The advantage of such silencing is that the user will not be subjected to the very loud alarm during the entire period that the self-test button is depressed. Not only will this lessen the discomfort of the user, but it will, as will be described more fully below, also allow the user to listen for the other interconnected hazardous condition detectors to determine the operational status of the interconnect and the detectors themselves.

Once the alarm has been silenced at step 510, the method of the present invention will check to see if the test button is still depressed by the user at step 512. If the user is still depressing the self-test button, the detector will transmit a remote self-test signal at step 514. While various known methods could be used to generate and transmit this remote self-test signal, preferably the signal would be encoded in accordance with U.S. Pat. No. 6,611,204, entitled "Hazard Alarm, System, and Communication Therefore", the teachings and disclosure of which are hereby incorporated in their entireties by reference thereto. This test method will then end 516.

Figure 6:
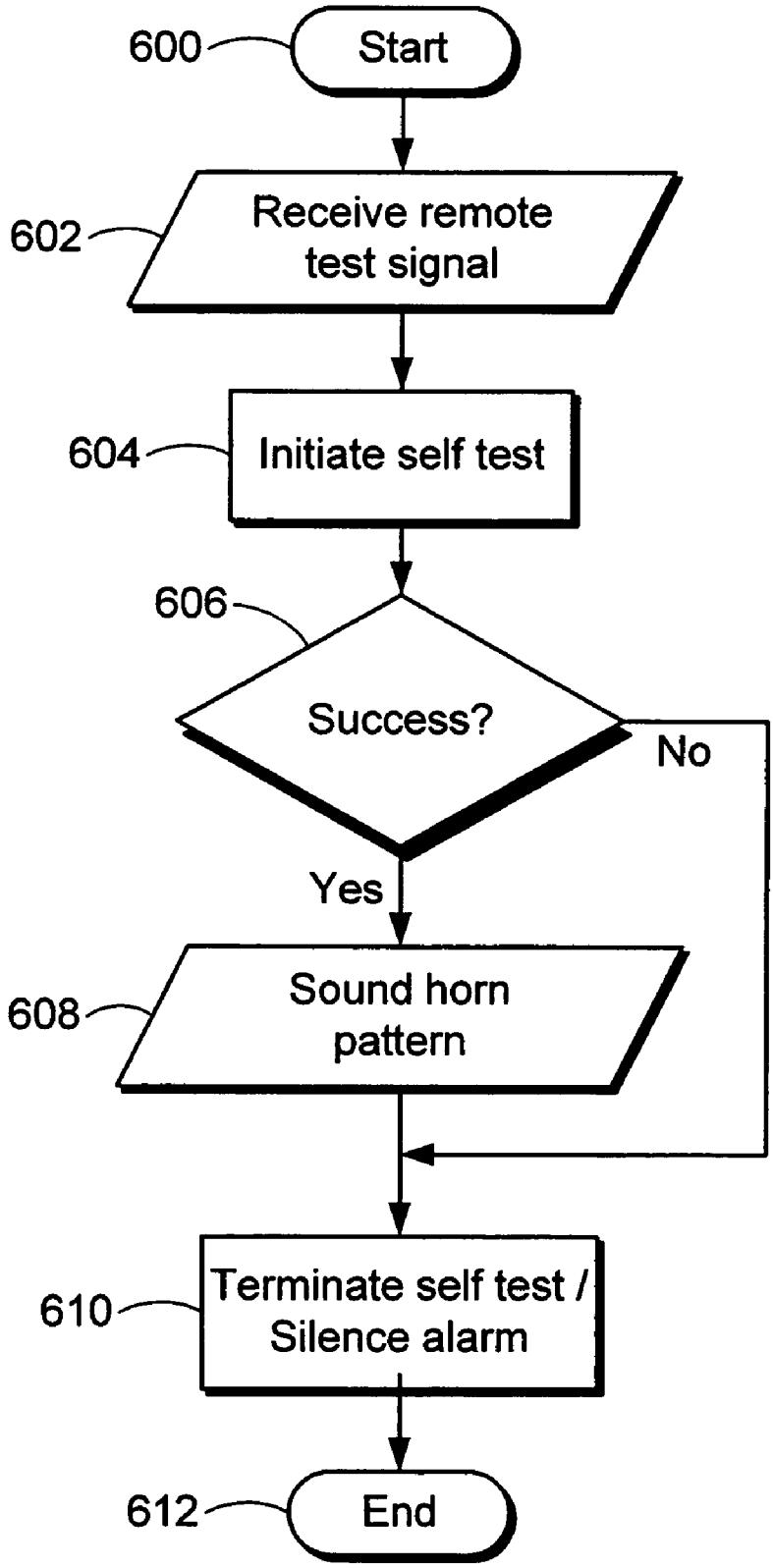
FIG. 6 is a flow diagram illustrating operation of a remote hazardous condition detector upon initiation of the test method of the present invention.

Within the remotely located hazardous condition detector, as illustrated in FIG. 6, the process begins 600 and the remote self-test signal is received 602 via the communications channel. This remote hazardous condition detector will then begin its internal self-test 604 as if a user had initiated the self-test via the test button on that detector. As discussed above, the particular tests performed during this self-test may vary, are beyond the scope of the instant invention, and therefore will not be discussed in detail herein. However, those skilled in the art are familiar with such self-tests performed on the functionality of the hazardous condition detectors. If the self-test is a success 606, the remote detector will sound its horn pattern 608. Once this has been completed, the remote detector will terminate its self-test and will silence its alarm 610, at which point the process in this remote hazardous condition detector will end 612.

In an alternate embodiment of the present invention, the method performed in the remote hazardous condition detector operates to ensure that the user be given an indication as to the operational integrity of the communications link between the detectors. As discussed above, this provides the user with an audible indication that the self-test signal was received to allow the user to determine the cause of a failure of the remote detector to sound its alarm pattern indicative of successfully passing its self test.

Figure 7:
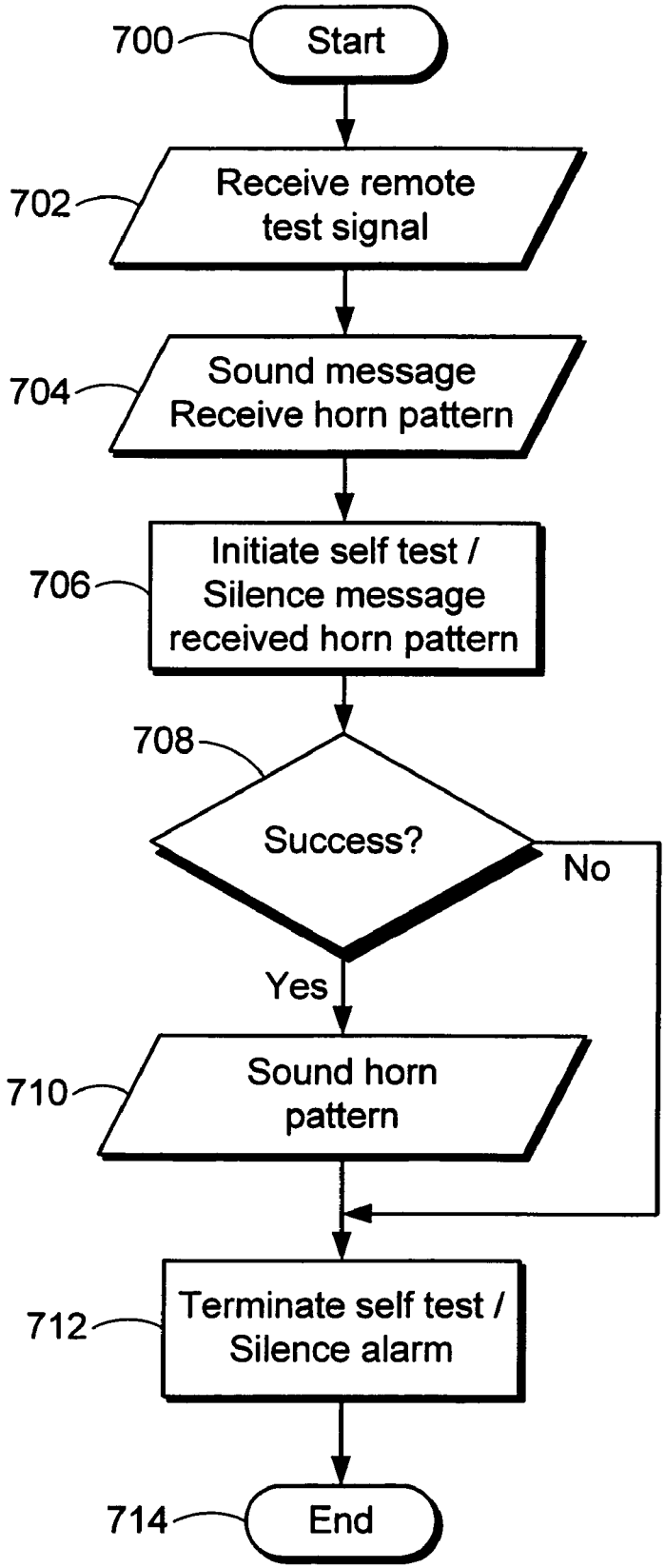
FIG. 7 is a flow diagram illustrating operation of a remote hazardous condition detector upon initiation of an alternate embodiment of the test method of the present invention.

Specifically, as illustrated in FIG. 7, the process begins 700 and the remote self-test signal is received 702 via the communications channel. This remote hazardous condition detector will then sound a message received horn pattern 704 to indicate to the user that the operational integrity of the communications link between the detectors is intact. Once this has been sounded, the remote detector will silence the message received horn pattern and begin its internal self-test 706 as if a user had initiated the self-test via the test button on that detector. As discussed above, the particular tests performed during this self-test may vary, are beyond the scope of the instant invention, and therefore will not be discussed in detail herein. However, those skilled in the art are familiar with such self-tests performed on the functionality of the hazardous condition detectors. If the self-test is a success 708, the remote detector will sound its horn pattern 710. Once this has been completed, the remote detector will terminate its self-test and will silence its alarm 712, at which point the process in this remote hazardous condition detector will end 714.

While one embodiment of the method described above requires the test button to be continuously depressed, another embodiment of the present invention operates to initiate the detector self-test and transmission of the remote self-test signal upon initial selection of the test button, without requiring the user to continuously hold the test button in a depressed position. That is, once the user has selected the test button, the self-test and remote self-test will run automatically without further user intervention required. Preferably, this embodiment of the present invention will allow the user to terminate the self-test and the remote self-test by selecting the self-test button a second time. Further, while the preferred embodiment does not transmit the remote self-test signal until completion of the local detector self-test, an alternate embodiment of the present invention allows the transmission of this remote self-test signal during the local detector's self-test. In a further embodiment, the remote self-test signal may be transmitted before the detector self-test. Still further, the transmission of the remote self-test signal may be in place of the local self-test, or may be initiated by a different test button on the detector. These additional embodiments provide flexibility within the scope of the present invention while achieving the objects of the present invention to better enable the user to determine the success or failure of the remote self-test method.

In prior systems, no self-self test for the remote detectors was ever accomplished. Further, with the interconnect tests that were available, it was difficult if not impossible to discern whether the remotely located, interconnected hazardous condition detectors were sounding their alarm or not because the hazardous condition detector which the user was depressing the self-test button continued to sound its very loud alarm. As a result of the near inability to discern the operational status of the interconnect along with the extreme discomfort resulting from extended exposure in close proximity to the alarming detector, many users simply would not attempt to perform this test. As a result, a user would be uninformed of a failure of the interconnect which is required by the NFPA. In such a situation, precious moments may be lost before the occupant is alerted to the hazardous condition that may have originally been detected several minutes earlier in a remote location. Such a situation is unacceptable. Still further, since the prior tests did not test the functionality of the remote detectors, the user was forced to physically go to each such detector and separately initiate the self test. Because of the time and hassle involved, many users do not test these detectors as recommended.

The method of the present invention, however, provides an effective method of testing not only the communications between the distributed hazardous condition detectors but also the operational status of the remote detectors themselves from any one of the interconnected detectors. This is accomplished with the present invention in a manner that lessens the discomfort of the user, and therefore encourages continued testing throughout the lifetime of the system.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A method for testing operational integrity of multiple, interconnected hazardous condition detectors from a local hazardous condition detector, comprising the steps of:

receiving a user input to initiate a detector self test for the local hazardous condition detector;

conducting the detector self test at the local hazardous condition detector;

sounding an alarm pattern at the local hazardous condition detector upon success of the detector self test;

silencing the alarm pattern of the local hazardous condition detector; and transmitting a remote self-test signal from the local hazardous condition detector to the interconnected hazardous condition detectors.

2. The method of claim 1, further comprising the step of confirming continued receipt of the user input, and wherein the step of transmitting the remote self-test signal is accomplished only after the step of confirming continued receipt of the user input.

3. The method of claim 1, wherein the step of transmitting the remote self-test signal is performed after the step of silencing the alarm pattern.

4. The method of claim 3, wherein the step of transmitting the remote self-test signal is accomplished only if the step of receiving a user input to initiate the detector self test is still true after the step of silencing the alarm pattern.

5. The method of claim 1, wherein the step of transmitting the remote self-test signal is performed even if the step of sounding the alarm pattern does not occur because of a failure of the self test.

6. The method of claim 5, wherein the step of transmitting the remote self-test signal is performed only if the step of receiving the user input is still true after the step of conducting the detector self test is complete.

7. The method of claim 1, further comprising the steps of:

receiving the remote self-test signal by at one of the interconnected hazardous condition detectors;

initiating a detector self-test by the at least one of the interconnected hazardous condition detectors; and sounding an alarm pattern at the at least one of the interconnected hazardous condition detectors upon success of the self-test.

8. The method of claim 7, further comprising the steps of:

silencing the alarm pattern of the at least one of the interconnected hazardous condition detectors; and terminating the detector self test at the at least one of the interconnected hazardous condition detectors.

9. The method of claim 7, further comprising the step of sounding a message received horn pattern at the at least one of the interconnected hazardous condition detectors upon receipt of the self-test signal to indicate receipt thereof.

10. A method of testing operational integrity of a hazardous condition detector, comprising the steps of:

receiving a remote self-test signal transmitted from an interconnected hazardous condition detector; and initiating a detector self-test.

11. The method of claim 10, further comprising the step of sounding an alarm pattern upon success of the self-test.

12. The method of claim 11, further comprising the steps of:

silencing the alarm pattern; and terminating the detector self test.

13. The method of claim 10, further comprising the step of sounding a message received horn pattern upon receipt of the remote self-test signal to indicate receipt thereof.

14. The method of claim 13, further comprising the step of terminating the message received horn pattern prior to the step of initiating the detector self test.

15. A method of testing the functionality of a system of interconnected hazardous condition detectors, comprising the steps of:

receiving a user input at one of the interconnected hazardous condition detectors to initiate testing of the detectors;

conducting testing of the interconnected hazardous condition detector which received the user input; and transmitting a remote self-test signal from the local hazardous condition detector which received the user input to remaining interconnected hazardous condition detectors to initiate testing thereof.

16. The method of claim 15, further comprising the steps of:

providing an audible indication when the testing of the hazardous condition detector which received the user input is successful;

continuing to receive the user input at the hazardous condition detector which received the user input after the step of conducting testing;

silencing the audible indication to allow a user to hear audible indications from the remaining hazardous condition detectors.

17. The method of claim 16, further comprising the step of aborting the method when the user input is no longer received.

18. The method of claim 16, wherein the step of transmitting the remote self-test signal is performed after the step of conducting testing of the detector if the step of continuing to receive the user input is true after the step of conducting testing of the detector is complete.

19. The method of claim 16, wherein the step of transmitting the remote self-test signal is performed regardless of success or failure of the step of conducting testing of the detector when the step of continuing to receive the user input is true.

20. The method of claim 15, further comprising the steps of:

receiving a remotely generated self-test signal from a remote interconnected hazardous condition detector; and initiating a self-test.

21. The method of claim 20, further comprising the step of providing a message received indication upon receipt of the remotely generated self-test signal.

* * * * *